US009505471B2

(12) United States Patent
Wunner

(10) Patent No.: US 9,505,471 B2
(45) Date of Patent: Nov. 29, 2016

(54) FIN FOR WATER SPORT AND A SURFBOARD FOR THIS PURPOSE

(71) Applicant: Felix Wunner, Munich (DE)

(72) Inventor: Felix Wunner, Munich (DE)

( * ) Notice: Subject to any disclaimer, the term of this patent is extended or adjusted under 35 U.S.C. 154(b) by 18 days.

(21) Appl. No.: 14/396,492

(22) PCT Filed: Apr. 2, 2013

(86) PCT No.: PCT/EP2013/000970
§ 371 (c)(1),
(2) Date: Mar. 13, 2015

(87) PCT Pub. No.: WO2013/159860
PCT Pub. Date: Oct. 31, 2013

(65) Prior Publication Data

US 2015/0191226 A1 Jul. 9, 2015

(30) Foreign Application Priority Data

Apr. 23, 2012 (DE) ..... 10 2012 008 278

(51) Int. Cl.
*B63B 35/79* (2006.01)

(52) U.S. Cl.
CPC ..... *B63B 35/7926* (2013.01); *B63B 35/79* (2013.01); *B63B 35/793* (2013.01)

(58) Field of Classification Search
CPC ..... B63B 35/79
USPC ..... 441/74, 79
See application file for complete search history.

(56) References Cited

U.S. PATENT DOCUMENTS 3,965,514 A * 6/1976 Shafer ..... B63B 35/793 441/79
4,325,154 A * 4/1982 Collum, Jr. ..... B63B 41/00 114/127
4,904,215 A * 2/1990 Sherwood ..... B63B 35/793 114/140
5,032,096 A * 7/1991 Scott ..... B29C 44/146 114/140
5,242,322 A * 9/1993 Chellemi ..... B63B 35/7926 114/219
5,273,472 A * 12/1993 Skedeleski ..... B63B 35/7926 114/140
5,306,188 A * 4/1994 Skedeleski ..... B63B 35/7926 114/140
5,480,331 A * 1/1996 Lewis ..... B29D 99/0025 114/127
5,813,890 A * 9/1998 Benham ..... B63B 35/7926 114/140
5,951,347 A * 9/1999 Hudson ..... B63B 35/7926 114/140
D445,867 S * 7/2001 Reudink ..... B63B 35/7933 D21/772
6,257,941 B1 * 7/2001 Rhynsburger ..... B63B 35/7933 441/79

(Continued)

FOREIGN PATENT DOCUMENTS

DE 91 00 911 U1 4/1991
DE WO 2013159860 A1 * 10/2013 ..... B63B 35/7926

(Continued)

OTHER PUBLICATIONS

International Search Report for PCT/EP2013/000970, mailing date Aug. 1, 2013.

*Primary Examiner* — Lars A Olson
*Assistant Examiner* — Jovon Hayes
(74) *Attorney, Agent, or Firm* — Fish & Richardson P.C.

(57) ABSTRACT

A fin for water sports is described, in particular for surfing, consisting of a base element (1), comprising at least two blade elements (2), the blade element respectively having at least a first and a second portion, and the respective first portion of the blade element covering the base element, and the blade elements being connected by the second portions, and having a bar integrated into the fin in order to facilitate and simplify turning maneuvers.

20 Claims, 10 Drawing Sheets

(56) References Cited

U.S. PATENT DOCUMENTS 6,394,865 B1 * 5/2002 Arzadon ..... B63B 35/7933 441/79
6,896,570 B1 * 5/2005 O'Keefe ..... B63B 35/793 441/79
6,918,806 B2 * 7/2005 Skedeleski ..... B63B 35/7926 114/140
8,083,560 B2 * 12/2011 Foulke ..... B63B 35/793 441/79
8,408,958 B2 * 4/2013 Benham ..... B63B 35/7926 441/74
8,465,334 B2 * 6/2013 Hort ..... B63B 35/793 441/79
8,556,670 B2 * 10/2013 Schultz, III ..... B63B 35/79 441/79
8,951,080 B2 * 2/2015 Schultz, III ..... B63B 35/79 441/79
9,045,202 B1 * 6/2015 Alarcon ..... B63B 35/7926
2015/0191226 A1 * 7/2015 Wunner ..... B63B 35/7926 441/74

FOREIGN PATENT DOCUMENTS

WO WO-2006/066140 A2 6/2006
WO WO-2008/125123 A1 10/2008

* cited by examiner

Section A:A

FIN FOR WATER SPORT AND A SURFBOARD FOR THIS PURPOSE

The following invention relates to a fin for water sports according to the preamble to claims 1 and 8 and to an appropriate surfboard for the latter.

The global surf industry market is growing in the same way as is the rapidly increasing popularity of trend sports. At the largest European location for the surf industry alone, i.e. Biarritz in France, 385 companies with approximately 3200 employees generate an annual turnover of more than 1.2 billion euros.

Since 1930, when stability-facilitating elements were fitted onto surfboards for the first time, numerous items have to date been put into practice on the rear part of the surfboard in order to optimise its complex functionality which is of essential importance for the user value of this board.

With regard to form, in all of the popular models a profile similar to fish fins and adapted fluid-dynamically can be seen. The use of materials such as epoxy resin or carbon fibre-reinforced plastic has a large influence upon manipulating the freedom of movement and flexibility of the fin tip by means of different laminate thicknesses as well as upon the weight reduction aspect. The properties of a fin are determined during production.

It is therefore known that rigid fins are used in order to guarantee directional stability. These fins are made from one piece and are mostly laminated. Only the flexibility in the tip of the fin is achieved by different usage of materials in thinner layers. The single reaction of the fin with a change in direction is manifested by the tip twisting in curving manoeuvres due to external forces. The forces act due to the resistance of the water, as can be seen for example in FIG. 10. When subsequently moving in a straight line the fin returns to the normal position.

Figure 10:
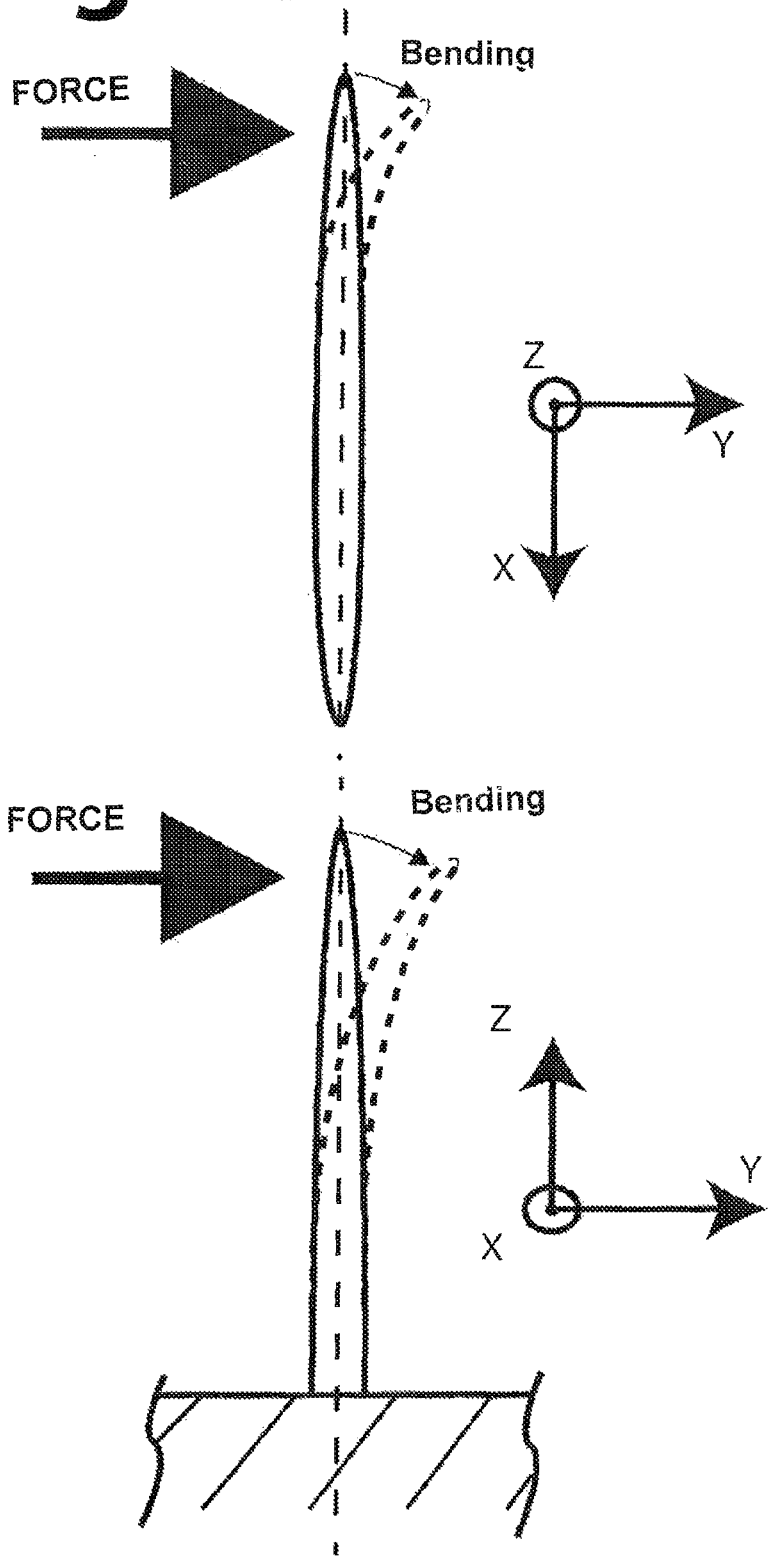
Fig. 10 Prior Art

According to FIG. 10 the front sides and geometric illustrations of a conventional fin are shown. In a curved manoeuvre conventional fins twist at the tip as a single degree of freedom. When rotational movements are introduced the fin bends away laterally to the fin axis and with a subsequent translatory movement the fin pushes back into the normal position. No additional functions facilitating handling are known.

It is therefore an object of the following invention to improve the features facilitating handling in comparison to conventional fins. Furthermore, it is another object of the following invention to actively facilitate the desired movement of the user.

These objects are achieved with the features of claims 1 and 8 and correspondingly claim 12.

As a result of the step according to the application whereby at least two blade elements are provided on the base element, it is possible for not only twisting of the fin tip to be brought about, but also for an additional part of the fin, which can move freely with respect to the base element, to be deflected, and so the initiation of a change in direction is facilitated. Since the blade elements are only connected by a first portion, it is possible to take the step whereby on the side of the fin facing away from the twisting, the second portion of the blade element lifts from the base element, and so as a result of the curvature of the second portion of the blade element an additional facilitating change in direction is introduced by means of the so-called lifting effect.

If, according to the application, a bar is additionally provided in the cover enclosing the base element, in particular due to the twisting of the fin tip, an additional part of the cover surrounding the blade elements, in particular at the end of the fin, will deflect, and so even deflection corresponding to the twisting of the fin tip is brought about by the bar. The bar, which is disposed at the end of the fin, therefore serves to transfer and deflect the twisting of the tip introduced due to the curving motion to another part of the cover which is arranged to move freely with respect to the base element.

Therefore, the fin according to the application describes a fin system which has an active influence upon handling when performing manoeuvres. Any kinetic and potential energy which arises during the performance is affected to a large extent by the use of materials the individual portions of which have different linear elastic characteristics. Furthermore, simple physical effects are used to generate lifting forces or lateral forces likewise facilitating the steering manoeuvre, for example by means of the change in shape of the first portion of the blade element which can lift from the base element due to the blade function. The fin according to the application adapts to the flow and generates facilitating lifting forces and resisting torques significant for steering manoeuvres.

In comparison to conventional fins the fin according to the application reacts to its environment and serves non-exclusively as stabilising elements which are rigid in form, as is the case with conventional fins. The steps and optimisations according to the application lead to improved handling of the surfboard while the user is performing manoeuvres.

If the blade element is respectively equipped with different elasticity modules or rigidities between an inner region and an outer region, with this step the functions facilitating the curving manoeuvre are easily provided. This is particularly the case if the elasticity module or the rigidity of the inner region is higher than the elasticity module or the rigidity of the outer region.

Advantageously, the base element is rigid in form and has an elasticity module or a rigidity which is higher than the elasticity module or the rigidity of the blade element, by means of which in particular the lateral forces or the lateral lifting forces of the first portion of the blade elements are preferably facilitated.

In order to basically protect the blade elements suspended on the base element from external influences, it is advantageous if the blade elements and the base element are surrounded by a cover which is preferably designed to be elastic and/or flexible. It is most optimal if the cover surrounds the blade element and the base element with form fit.

Depending on the production technique it is advantageous if the respective blade elements are, if appropriate, produced in one piece in order to best counter the material stresses occurring due to the constant twisting. However, it can also be advantageous in manufacture if each blade element is produced separately, which element is then connected and adhered with force fit, and advantageously in the second portion so that, furthermore, the first portion can lift from the base element if the blade element is suspended on the base element and the blade element rests loosely with the first portion against the base element.

If, advantageously, the bar with a blade element enclosing the base element is integrated, fixed, into the distal portion, the distal portion being viewed from the connection of the base element to the water sport device, due to the curved movement the bar executes the corresponding twisting and transfers the twisting onto its proximal portion and deflects the cover according to the deflection of the fin tip. In this way the facilitating twisting of the fin tip is transferred to another region of the cover, and so facilitates the curved movement. The connection point between the distal portion and the proximal portion of the bar therefore constitutes a pivot point which defines an axis of rotation which lies in the longitudinal direction of the fin.

If the distal portion of the bar is configured to be longer than the proximal portion of the bar, the fixed, integrated part of the bar within the cover or on the blade element can perform an improved force transmission onto the distal part of the bar and so onto the corresponding cover.

Further advantageous configurations of the present invention are the subject matter of the other sub-claims.

An advantageous embodiment of the present application subject matter is shown by means of the following drawings.

Figure 1:
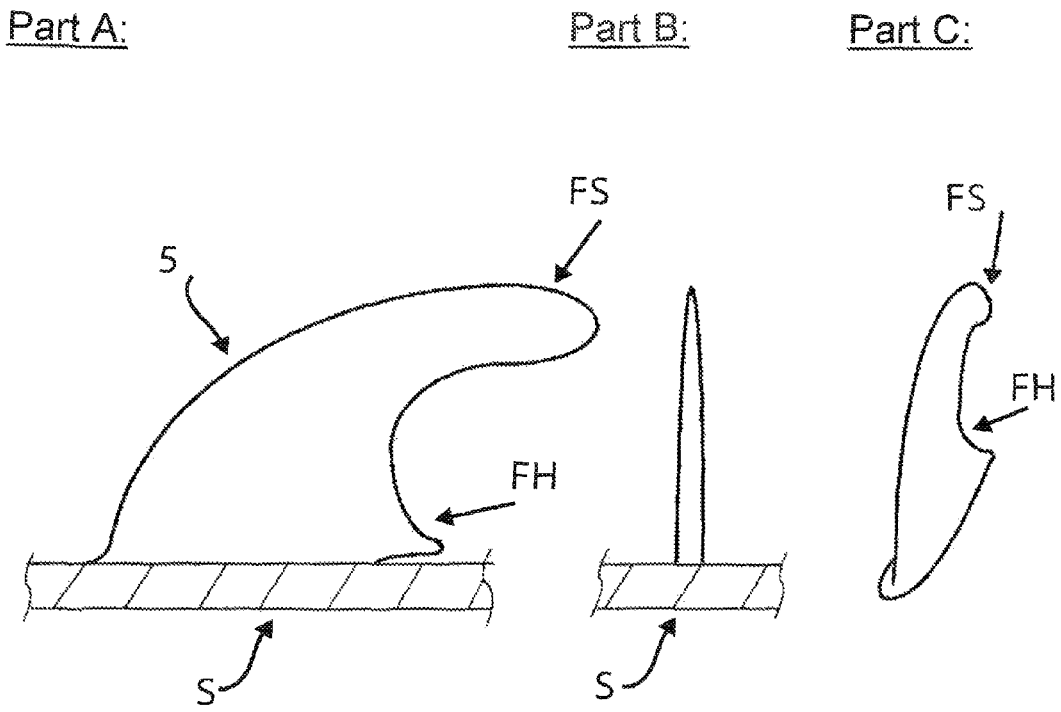
Figure 2:
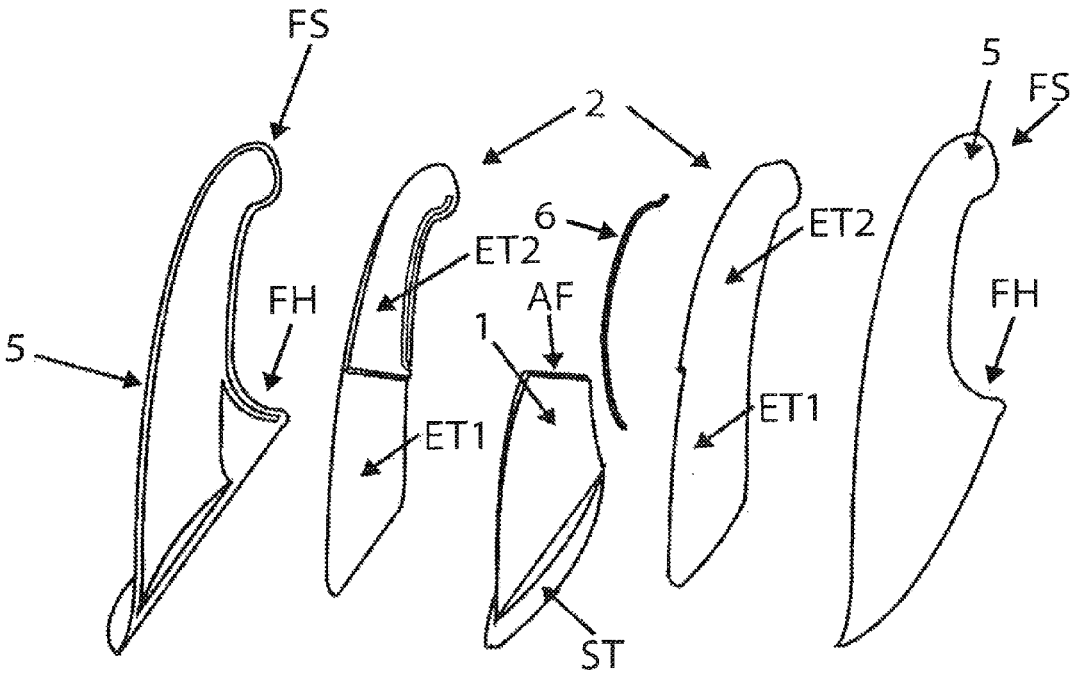
Figure 3:
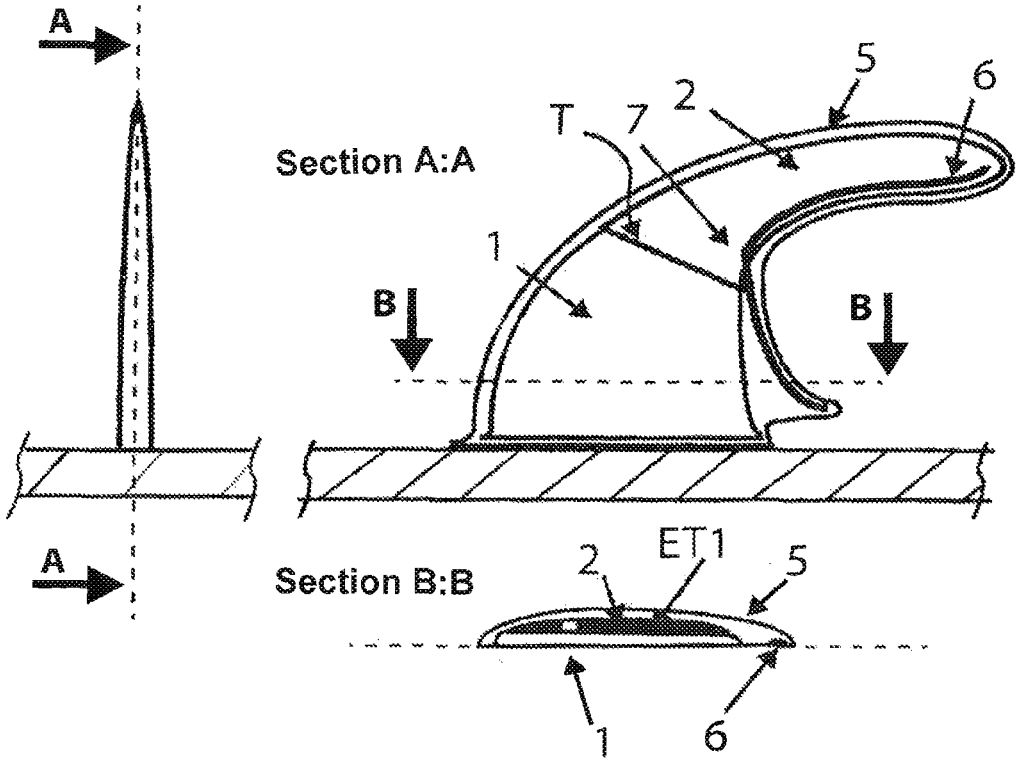
Figure 4:
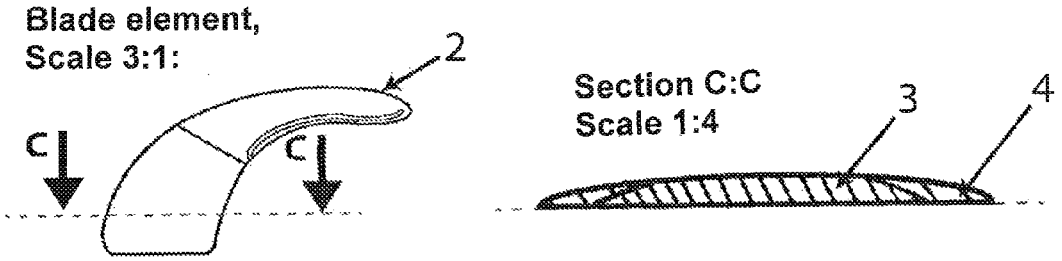
Figure 5:
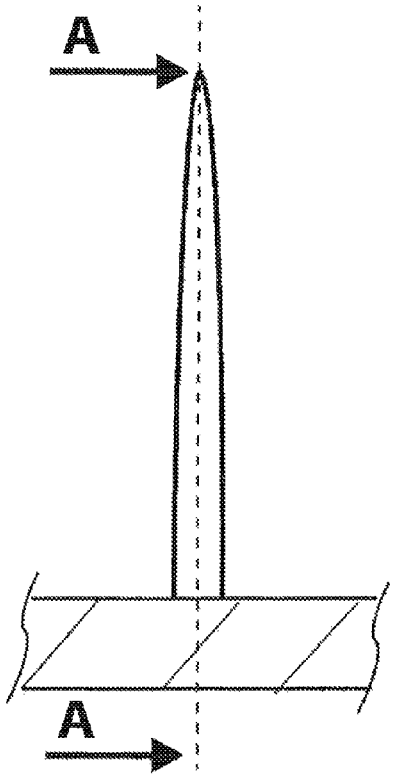
Figure 5:
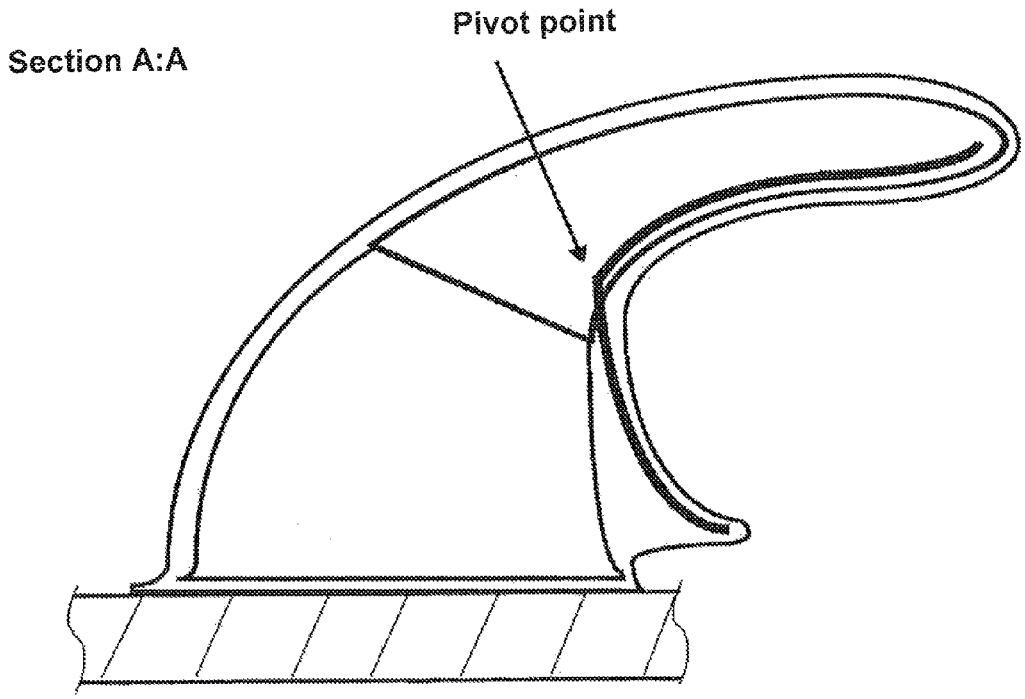
Figure 6:
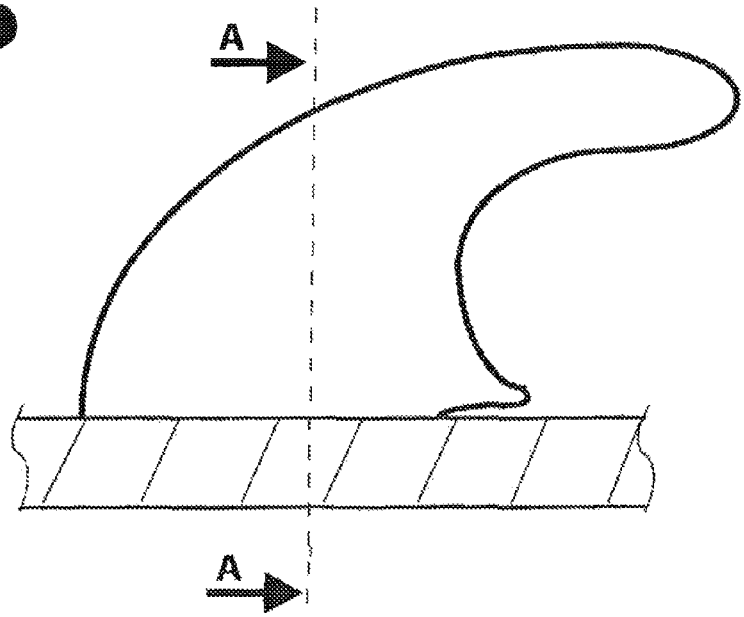
Figure 6:
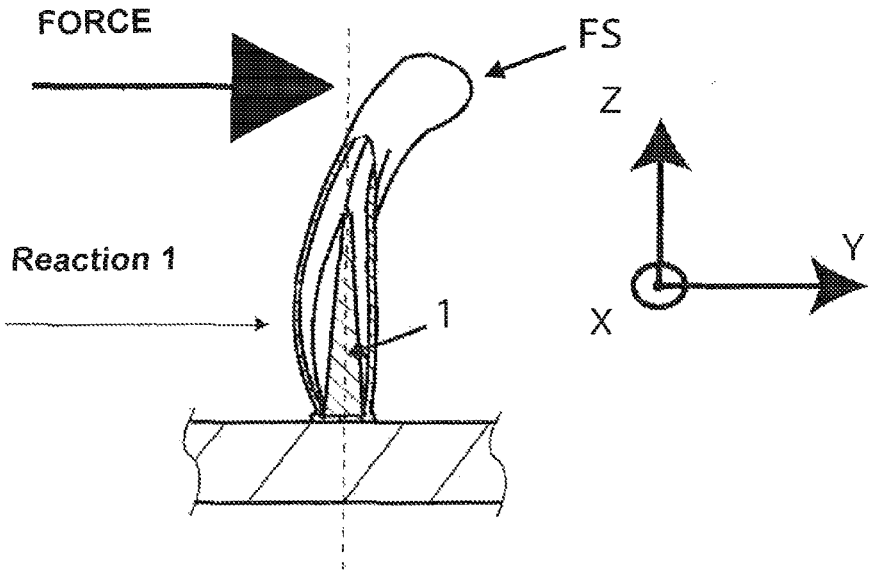
Figure 7:
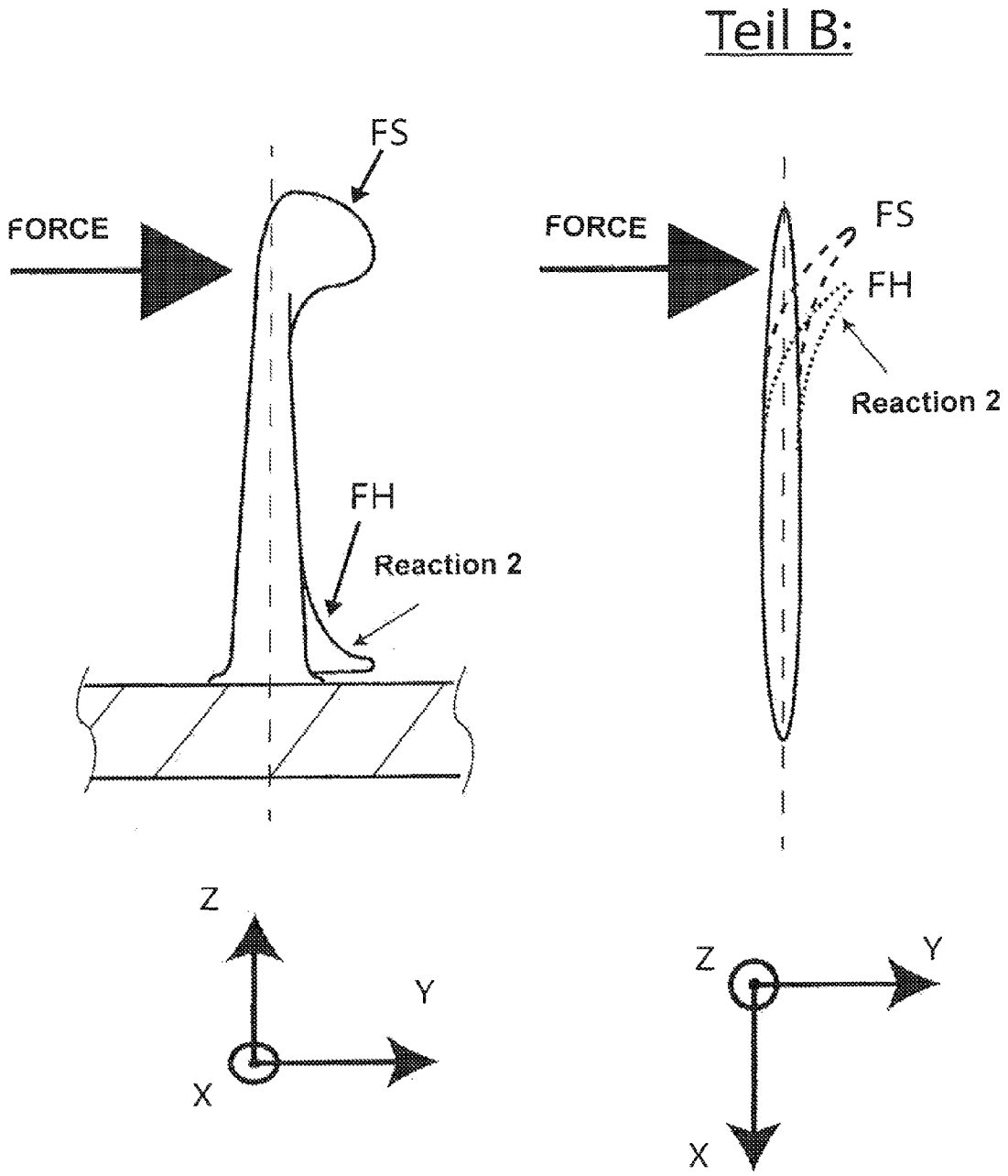
Figure 8:
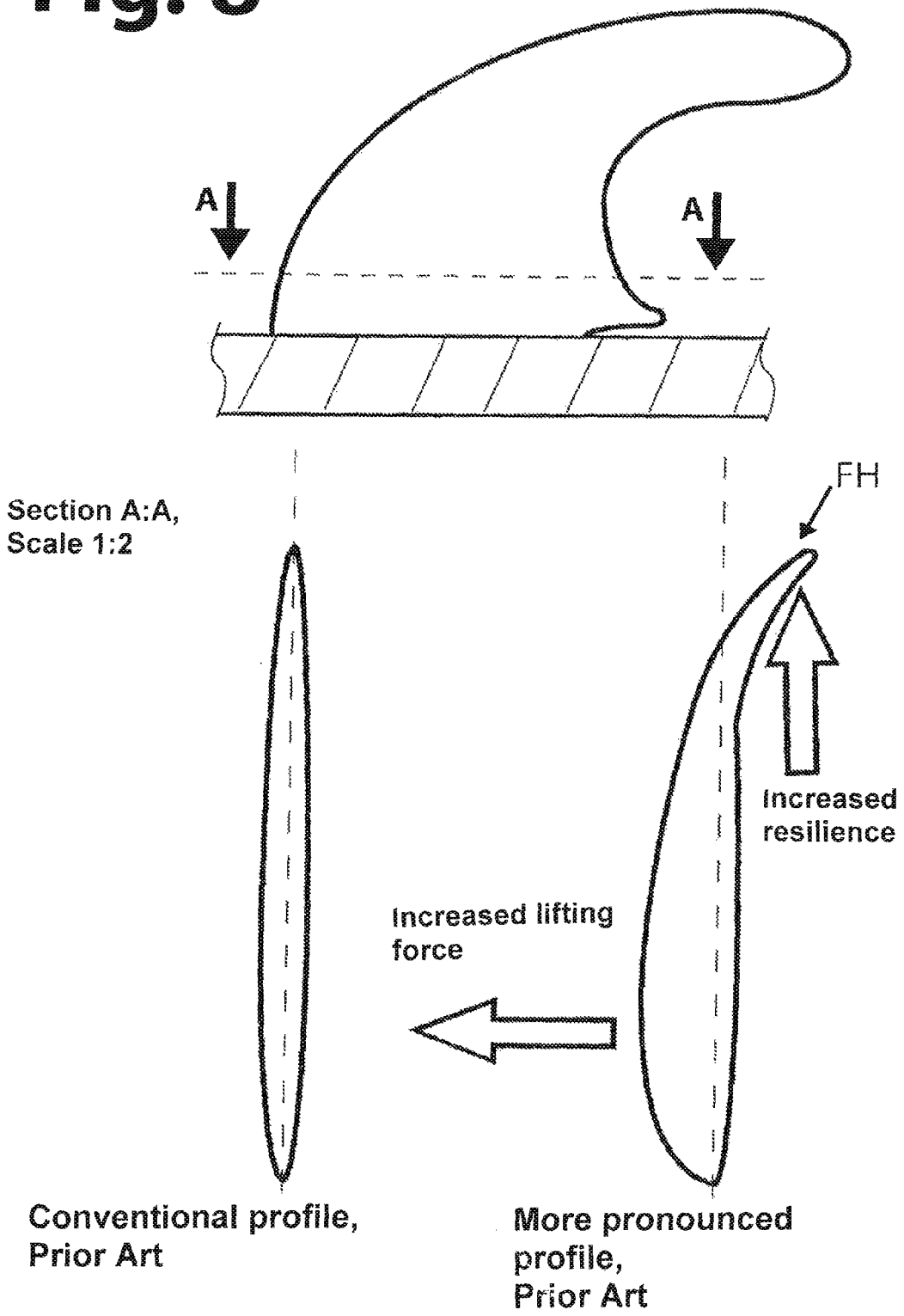
Figure 9:
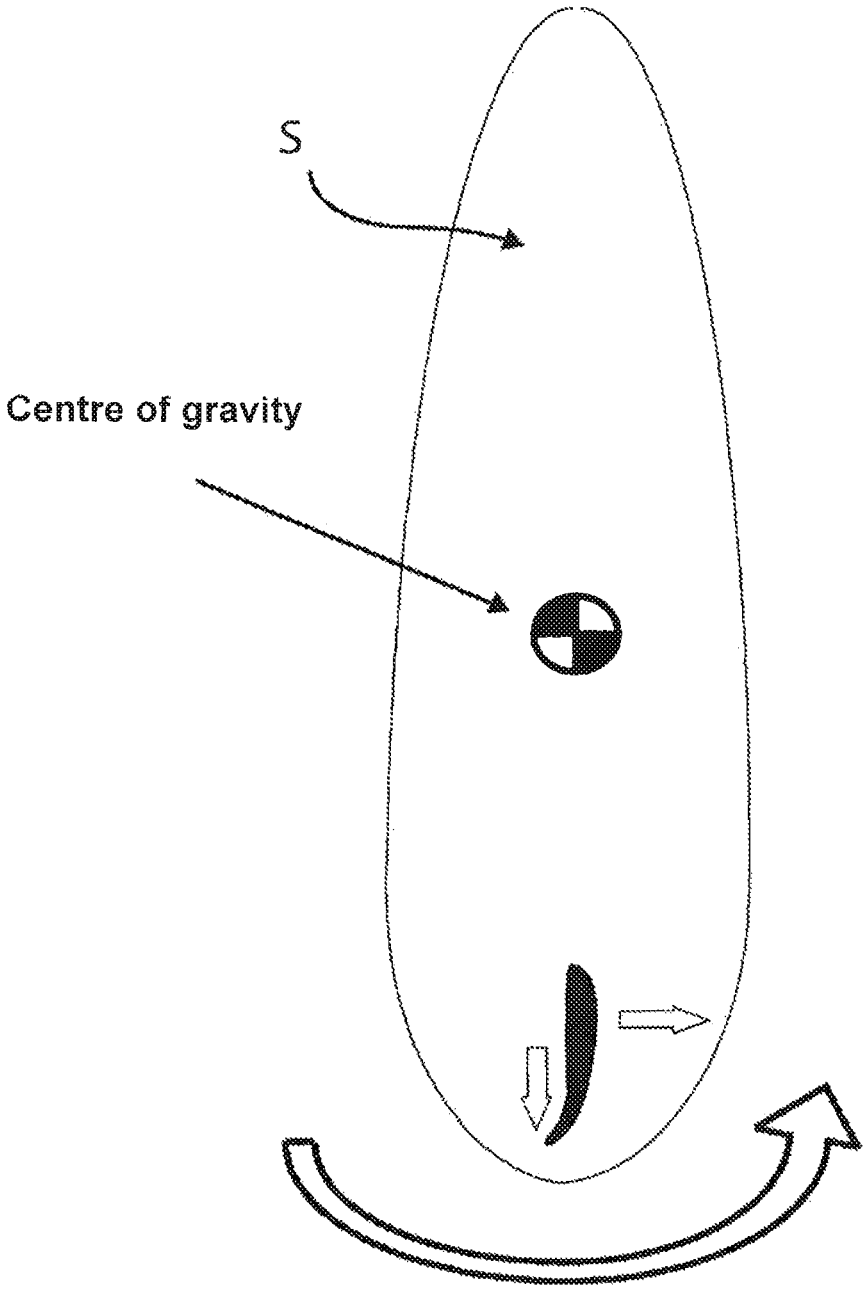

FIG. 1 shows the side view, the front view and the perspective view of the fin according to the application FIG. 2 shows an exploded illustration of the fin according to the application FIG. 3 shows a sectional drawing of the fin according to the application FIG. 4 shows a sectional view of a blade element of the fin according to the application FIG. 5 shows, in an enlarged representation, the sectional drawing according to FIG. 3 in order to illustrate the resulting pivot point FIG. 6 shows the fin according to the application during a curved manoeuvre and the respective deflections (reaction 1) in the sectional view FIG. 7 shows the twisting of the fin tip and of the additional part of the cover (reaction 2) both in the front view and in the top view FIG. 8 shows the respective influences of force of the fin according to the application with respect to a conventional profile FIG. 9 shows the respective influences of rotation of a surfboard using the fin according to the application FIG. 10 shows both the top view and the front view of a conventional fin according to the prior art respectively in a sectional drawing In FIG. 1 a side view of the fin according to the application is shown which is fitted on a surfboard S and in the side view primarily shows the cover 5 which shows both a fin tip FS and part of the cover FH which is arranged so as to move freely with respect to the surfboard. In part B of FIG. 1 the front view of the fin according to application is shown on the surfboard which, in the rest position, is not basically distinguishable from a conventional fin. In part C of FIG. 1 the perspective fin is shown in which in turn the fin tip FS and the freely moving part of the cover can be seen.

In FIG. 2 the fin according to the application is reproduced in an exploded illustration. The fin according to the application consists of a base element 1 and at least two blade elements 2 which are enclosed by the cover 5. The base element 1 has a face surface ST which can be connected to the water sport or surfboard. Furthermore, the base element 1 has a contact surface AF lying opposite the face surface ST and which serves as a thrust bearing or suspension surface for the blade elements 2, portions of the blade elements 2 resting against the base element due to the positioning and connection of the blade elements 2 so as, if appropriate, to be able to lift from the base element in a curved manoeuvre. Additionally, FIG. 2 shows the bar 6 which transfers the twisting of the fin tip FS onto the part of the cover FH that moves freely with respect to the base element 1. One can also see that each blade element has a first portion ET1 and a second portion ET2. The blade elements are connected by the second portion ET2 and, corresponding to the separation region, are suspended or connected onto the base element 1 between the first portion ET1 and the second portion ET2. With this step it is possible for the first portion ET1 to lift from the base element 1 and so brings about an additional lifting force to facilitate a rotational movement of the surfboard. Nevertheless, the bar 6 is integrated on the rear side of the fin so that when the fin tip FS is deflected, the flexible part of the cover FH is also deflected.

In FIG. 3, in particular on the basis of sectional view A:A, the respective combination of the blade elements 2 with the base element 1 is reproduced, and this shows the first and the second portion of the blade element by means of the separation region T. In addition, one can see in sectional view A:A how the bar 6 is positioned in the cover 5. This is also reproduced in sectional view B:B. In sectional view B:B one can see how the first portion ET1 of the blade element 2 rests against the base element 1 and is enclosed by the cover 5. One can also see how the bar 6 is positioned in the cover.

In FIG. 4 a sectional view of a blade element is shown, by means of which it can be seen that the blade element has two regions and the elasticity module and the rigidity of the inner region 3 is different from the elasticity module or the rigidity of the outer region 4.

In FIG. 5 sectional view A:A, where the pivot point lies between the distal part of the bar and the proximal part of the bar, is correspondingly shown.

In FIG. 6 a fin performing a curving manoeuvre is shown, the fin tip FS being twisted and deflected, in particular due to the force effect and, due to the twisting, the opposing first portion of the blade element lifting from the base element 1 and so generating a bulge or enlargement of the surface which generates a lateral force or lateral lifting force. Nevertheless, it is shown that the blade element adjacent to the twisting is pressed against the base element and so a stabilisation function of the force effects upon the fin is also brought about during the curving manoeuvre. Therefore, due to this bulge the rotational movement is facilitated.

In FIG. 7 a front view of the fin according to the application is reproduced, wherein the fin tip FS in particular as well as the flexible part of the cover FH is reproduced when deflected. FIG. 7 also shows the top view from which in particular the double deflection brought about by the bar according to the application both of the fin tip FS and of the moveable part of the cover FH can be seen. The rotation of the surfboard is assisted by this double or facilitating deflection.

In FIG. 8 an illustration comparing a conventional profile and the profile of the fin according to the application is reproduced, which profile is executing a curved movement according to section A:A. On the basis of this illustration it can be seen that on the one hand the deflected fin tip FS, but also the flexible part of the cover FH lead to increased resilience which, according to the illustration, guides the surfboard in a rotational movement in the anticlockwise direction, and likewise, the lifting force generated by the blade element lifted from the base element executes another rotational movement which facilitates manoeuvring for the user. This is shown in particular by means of FIG. 9 when both force arrows act on the surfboard with respect to the centre of gravity of the surfboard.

In general therefore it can be established in conclusion that in particular two new reactions are brought about with respect to conventional fins. On the one hand an increased deflection of the fin tip FS with the freely moving part of the cover FH which is generated by an integrated bar, and an increased lateral "lifting force" which likewise increases the rotational movement onto the surfboard.

In the following the two reactions and advantages are explained:

The advantages achieved by the invention consist in particular of the twisting of the tip when there are changes in direction leading both to a bulge in one of the lower blade elements (reaction 1) and to inwards rotation of the rear part of the elastic cover (reaction 2) lying against the water sport device (reaction 2). The two reactions take place simultaneously and are described below:

Reaction 1:

The aforementioned bulge is caused by the bending (due to the effect of external forces with changes in direction) of the upper blade element and the corresponding release of the lower blade element which lies loosely and with form fit on the base. The outer regions of the blade elements, which have a different elasticity module and a different rigidity than the inner regions, are held on the base by the elastic cover. Consequently, only the inner blade element with the highest elasticity module or the highest rigidity curves outwards, see drawing 4.

Reaction 2:

When the fin tip FS twists, the upper part of the bar integrated into the blade elements is also turned in. A pivot point is created on the rear upper end of the rigid base element, see drawing 5.

Consequently, the lower or proximal part of the bar is turned in the same direction and moves the elastic cover out of the longitudinal axis of the water sport device at the side. A lever is produced. This is because the upper or distal bar part integrated into the blade elements exceeds the length of the lower part located within the elastic cover, see drawing 6.

Forces which trigger the torsional moment described below are produced by the two aforementioned reactions of the fin.

Forces and moments arising from reaction 1:

It is known that an enhanced bulge in profiles generates increased lift. In the case of the invention the curvature introduced by the bend of the tip produces in the lower part a force in the plane of the water sport device and at right angles to the longitudinal axis of the fin, see drawing 7.

Forces and moments arising from reaction 2:

The rear part of the bar and consequently of the elastic cover turned in by the twisting leads to a resilience parallel to the longitudinal axis of the water sport device in a direction opposing the direction of travel.

This force is offset to the longitudinal axis of the water sport device and forms a lever arm to the centre of gravity of the water sport device, see drawing 7.

Consequence of the two reactions:

The sum of the two forces introduced by reactions 1 and 2 forms forces and consequently an increased torsional moment on the rear part of the water sport device, see drawing 8. In other words, narrower radii can be implemented with less expenditure of energy.

The surface of conventional fins is retained so as to still guarantee sufficient resistance for stabilisation.

The invention claimed is:

1. A fin for water sports, the fin comprising: a base element; and at least two blade elements provided on the base element, each blade element having at least a first and a second portion, the first portion of each blade element covering the base element, the second portion of each of the blade elements connecting the blade elements together, wherein the blade elements are connected to the base element and suspended on a contact surface so that the first portion of the blade elements can independently lift from the base element.

2. The fin according to claim 1, wherein each blade element has an inner region and an outer region with different elasticity or different rigidities.

3. The fin according to claim 1, wherein the base element is rigid or has a higher elasticity or rigidity than the blade elements.

4. The fin according to claim 1, further comprising a cover which surrounds the blade elements and the base element.

5. The fin according to claim 4, wherein the elasticity or rigidity of the cover is less than that of the outer regions of the blade elements.

6. The fin according to claim 1, wherein the blade elements are connected by the respective second portions.

7. The fin according to claim 1, further comprising a cover which surrounds the blade elements and a bar provided on a rear end of the fin in the cover.

8. The fin according to claim 7, wherein the bar is located on a portion of the base element and is moveable within the proximal portion of the cover.

9. The fin according to claim 7, wherein the bar is surrounded by an elastic cover.

10. The fin according claim 7, wherein the distal part of the bar is longer than the proximal part of the bar, and the distal part and the lower part of the bar are divided by a pivot point.

11. A surfboard using the fin of claim 1.

12. The surfboard according to claim 11, wherein the base element of the fin is connected perpendicularly to an underbody of the surfboard, and the blade elements are disposed to the side of the base element, part of the cover surrounding the blade elements being arranged so as to move freely in order to follow the movement of a tip of the fin.

13. The surfboard according to claim 12, wherein the movement of the freely moving part of the cover is made possible by a bar provided in the cover.

14. The fin according to claim 2, wherein the elasticity module or the rigidity of the inner region is higher than the elasticity module or the rigidity of the outer region.

15. The fin according to claim 1, wherein the blade elements are adhered to the base element.

16. The fin according to claim 5, wherein the cover is elastic.

17. The fin according to claim 5, wherein the cover is form fit over the blade elements.

18. A fin for water sports, the fin comprising:

a base element; and at least two blade elements provided on the base element, each blade element having at least a first and a second portion, the first portion of each blade element covering the base element, the second portion of each of the blade elements connecting the blade elements together, wherein each blade element has an inner region and an outer region with different elasticity or different rigidities.

19. The fin according to claim 18, further comprising a cover which surrounds the blade elements and the base element.

20. The fin according to claim 19, wherein the elasticity or rigidity of the cover is less than that of the outer regions of the blade elements.

* * * * *